United States Patent [19]

Nakajima

[11] Patent Number: 5,024,591

[45] Date of Patent: Jun. 18, 1991

[54] VANE COMPRESSOR HAVING REDUCED WEIGHT AS WELL AS EXCELLENT ANTI-SEIZURE AND WEAR RESISTANCE

[75] Inventor: Nobuyuki Nakajima, Saitama, Japan

[73] Assignee: Diesel Kiki Co., Ltd., Tokyo, Japan

[21] Appl. No.: 352,099

[22] Filed: May 15, 1989

[51] Int. Cl.[5] ..... F04C 18/344; F04C 29/00

[52] U.S. Cl. ..... 418/178; 418/179

[58] Field of Search ..... 418/178, 179

[56] References Cited

U.S. PATENT DOCUMENTS

| | | | |
|---|---|---|---|
| 3,506,383 | 4/1970 | Ewalt | 418/178 |
| 3,552,895 | 1/1971 | Bayley | 418/178 |
| 4,571,165 | 2/1986 | Murata | 418/178 |
| 4,577,549 | 3/1986 | Frank et al. | 92/169.1 |
| 4,616,985 | 10/1986 | Hattori et al. | 418/178 X |
| 4,778,352 | 10/1988 | Nakajima | 417/295 |
| 4,820,140 | 4/1989 | Bishop | 418/178 X |

FOREIGN PATENT DOCUMENTS

| | | | |
|---|---|---|---|
| 50-33712 | 10/1975 | Japan . | |
| 60-60993 | 3/1987 | Japan . | |
| 63-167094 | 7/1988 | Japan | 418/178 |
| 63-201388 | 8/1988 | Japan | 418/178 |
| 63-230978 | 9/1988 | Japan | 418/178 |
| 1-8383 | 1/1989 | Japan | 418/178 |
| 1-32087 | 2/1989 | Japan | 418/178 |
| 1-73185 | 3/1989 | Japan | 418/178 |
| 1-73186 | 3/1989 | Japan | 418/178 |
| 2074247 | 10/1981 | United Kingdom | 418/178 |

*Primary Examiner*—John J. Vrablik

*Attorney, Agent, or Firm*—Frishauf, Holtz, Goodman & Woodward

[57] ABSTRACT

A vane compressor in which a cylinder block, front and rear side blocks, a rotor, and vanes are formed of an aluminum-based alloy, and at least one of the component parts are coated with Ni electroless composite plating layers having polytetrafluoroethylene (PTFE) dispersed therein. The vane compressor further includes a capacity-controlling plate interposed between the rear side block and the rotor, which is formed of the aluminum-based alloy and coated with the Ni electroless composite plating layer having PTFE dispersed therein.

5 Claims, 3 Drawing Sheets

VANE COMPRESSOR HAVING REDUCED WEIGHT AS WELL AS EXCELLENT ANTI-SEIZURE AND WEAR RESISTANCE

BACKGROUND OF THE INVENTION

This invention relates to a vane compressor which is reduced in weight by forming vanes, a cylinder block, a rotor, side blocks, etc. thereof from an aluminum-based alloy (hereinafter referred to as "an aluminum alloy").

A vane compressor in general comprises a cylinder block having a camming inner peripheral surface of a substantially elliptical cross-section, a pair of side blocks closing front and rear open ends of the cylinder block to form a cylinder, a rotor rotatably received within the cylinder, and a plurality of vanes slidably fitted in respective vane slits formed in the outer peripheral surface of the rotor to be urged against the inner peripheral surface of the cylinder block to divide the interior of the cylinder into compression chambers which are varied in volume with rotation of the rotor, whereby a refrigerant gas drawn into the compression chambers is compressed.

Recently, many vane compressors are made from aluminum alloys instead of iron-based alloys in order to reduce their weights. For example, vane compressors of this type have been proposed by Japanese Utility Model Publication (Kokoku) No. 50-33712, and Japanese Provisional Patent Publication (Kokai) No. 62-60993.

According to the vane compressor proposed by the Japanese Kokoku, vanes are formed of an aluminum alloy for weight-reducing purpose, and the surfaces of the vanes are anodized to have aluminum oxide films coated thereon while being impregnated with polytetrafluoroethylene (PTFE) in order to improve the anti-seizure and wear resistance. According to the vane compressor proposed by the Japanese Kokai, the sliding surfaces of the vanes are coated with a Ni-based alloy material containing ceramic powder as a disperse phase to impart excellent anti-seizure and wear resistance to the compressor.

These proposed vane compressors have attained weight reduction by the use of a light metal, i.e. an aluminum alloy. However, in the above conventional compressor disclosed by the Japanese Kokoku, the anodic coating film, i.e. the aluminum oxide film coated over the vanes is basically of the same kind material as the material forming the surfaces of the cylinder block, rotor, etc. against which the vanes slide, and therefore, cannot give sufficient slidability, wear resistance, and durability. In the above conventional compressor disclosed by the Japanese Kokai, due to the ceramic dispersed in the Ni-based alloy coating material, the coating film is very hard, showing, for example, Hv=3000–3500 in the case of the ceramic being SiC, Hv=2800–3800 in the case of the ceramic being TiC, and Hv=2400–2800 in the case of the ceramic being $Si_3N_4$. Therefore, the coating film has low abrasiveness, so that it takes much time to grind the film, resulting in a shortened life of the abrasive grinder, as well as poor productivity. Further, although it has also been employed to coat compressor component parts with iron, this suffers from low stability in the thickness of a film formed by the coating, requiring finishing of the film after the coating, which results in increased manufacturing cost. Further, the adhesion of the film to the aluminum alloy is lower due to repetition of thermal shock during operation of the compressor, leading to a shortened life of the vanes.

SUMMARY OF THE INVENTION

It is an object of the invention to provide a vane compressor which is reduced in weight and has excellent anti-seizure and wear resistance.

Another object of the invention is to provide a vane compressor which has high productivity and hence a low manufacturing cost.

To attain the above objects, the present invention provides a vane compressor including a cylinder formed by a cylinder block, and front and rear side blocks closing opposite ends of the cylinder block, a rotor rotatably received within the cylinder, the rotor having vane slits formed in an outer peripheral surface thereof, and vanes slidably fitted respectively in the vane slits. The vane compressor is characterized in that the cylinder block, front and rear side blocks, rotor and vanes are formed of an aluminum-based alloy, and at least one of the cylinder block, front and rear side blocks, rotor and vanes are coated with Ni electroless composite plating layers having polytetrafluoroethylene (PTFE) dispersed therein.

The above and other objects, features, and advantages of the invention will become more apparent from the ensuing detailed description taken in conjunction with the accompanying drawings.

DETAILED DESCRIPTION

The invention will now be described in detail with reference to the drawings showing embodiments thereof.

Figure 1:
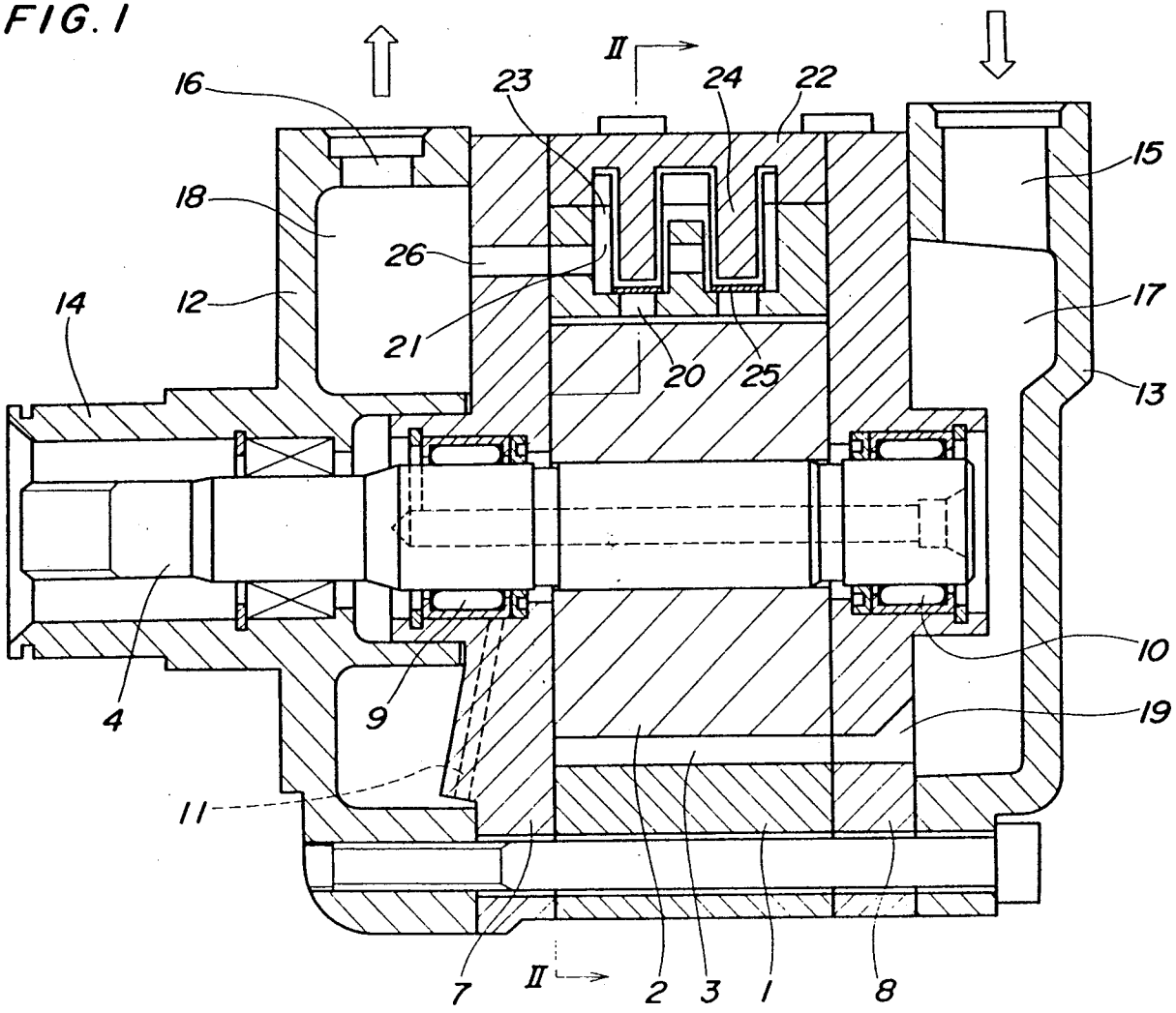
FIG. 1 is a longitudinal cross-sectional view of a vane compressor according to a first embodiment of the present invention taken along line I—I in FIG. 2.
Figure 2:
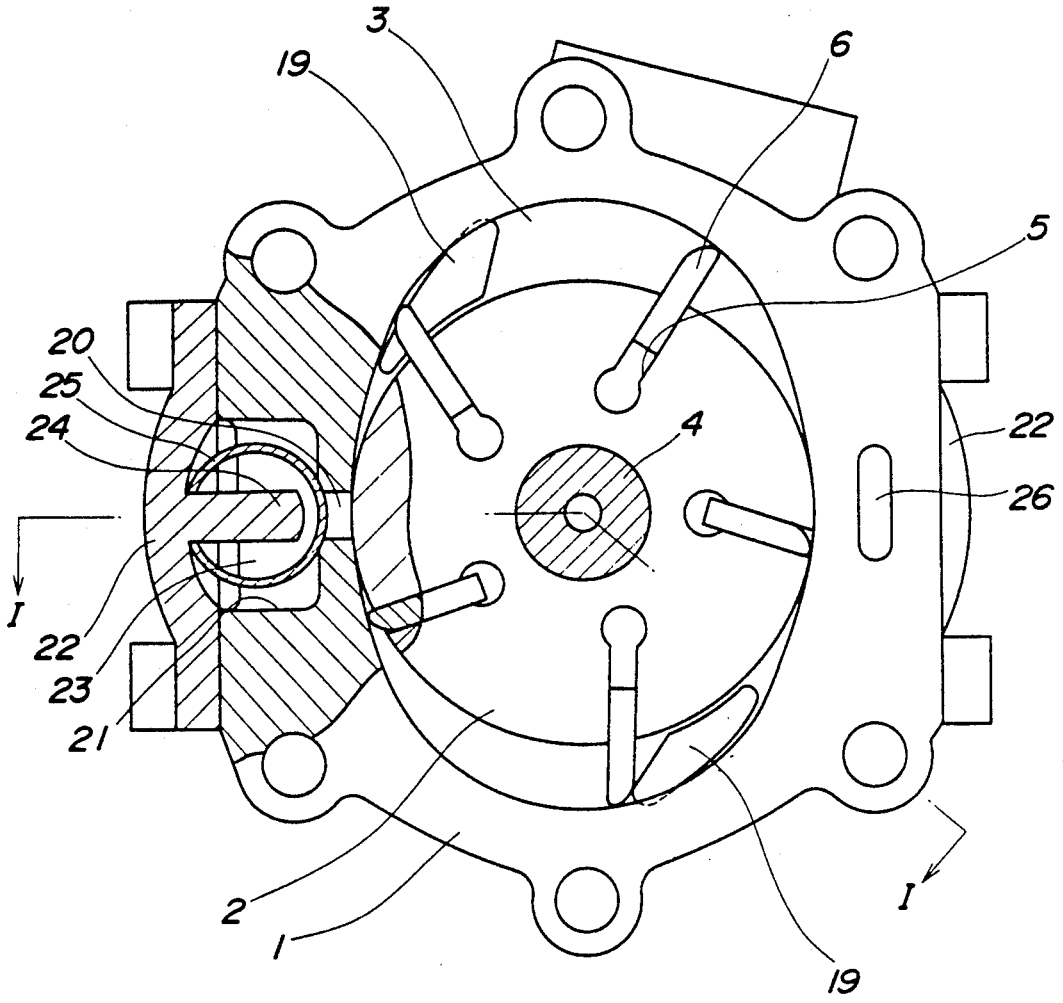
FIG. 2 is a transverse cross-sectional view of the vane compressor taken along line II—II in FIG. 1.
Figure 3:
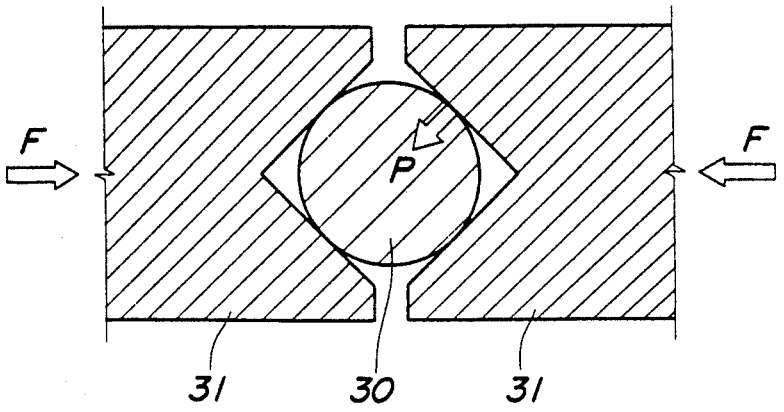
FIG. 3 is a cross-sectional view of a pin and blocks useful in explaining Falex test.

Referring first to FIGS. 1 through 3, a vane compressor according to a first embodiment of the invention is illustrated. A cylinder block 1 having a camming inner peripheral surface of a substantially elliptical cross-section has opposite open ends thereof closed by front and rear side blocks 7, 8 secured thereto, to form a cylinder together. A rotor 2 is received within the cylinder such that it is in contact with the inner peripheral surface of the cylinder block 1 at two diametrically opposite locations corresponding to the shortest diameter portions of the elliptical cross-section of the cylinder block 1. The rotor 2 divides the hollow interior of the cylinder block 1 into two diametrically symmetrical working spaces 3. The rotor 2 is secured on a driving shaft 4 extending through a central bore of the rotor 2. A plurality of, e.g. five, vane slits 5, are formed substantially radially in the outer peripheral surface of the rotor 2, in which are slidably received respective vanes 6.

The rotor 2 and the vanes 6 are in contact with the side blocks 7, 8 to define five compression chambers between the cylinder block 1, rotor 2, vanes 6, and side blocks 7, 8. The driving shaft 4 is rotatably supported by the side blocks 7, 8 by way of bearings 9, 10. The front side block 7 has a lubricating oil-supply hole 11 formed therein, which supplies lubricating oil collected in a sump at the bottom of a front head 12 to the sliding surfaces of the rotor 2 and the front side block 7, and the inner end faces of the vanes 6.

The front head 12 and a rear head 13 are secured on the outer ends of the side blocks 7, 8. The front head 12 has a central hub forwardly projected to form a cylindrical clutch-mounting portion 14, where power from an engine, not shown, is transmitted to the driving shaft 4 by way of an electromagnetic clutch, not shown. The rear head 13 has a suction port 15 formed therein, while the front head 12 has a discharge port 16 formed therein. The suction port 15 opens into a low pressure chamber (suction chamber) 17 defined between the rear side block 8 and the rear head 13, while the discharge port 16 opens into a high pressure chamber (discharge pressure chamber) 18 defined between the front side block 7 and the front head 12. Refrigerant inlet ports 19, are formed through the rear side block 8 at diametrically opposite locations such that the working spaces 3 communicate with the low pressure chamber 17 therethrough. Two sets of two paired refrigerant outlet ports 20 are formed in the cylinder block 1 at opposite side wall portions thereof, one end of each hole 20 opening into an associated one of the working chambers 3 at a location corresponding to one of the shortest diameter portions of the cross-section of the cylinder block 1. The two opposite side wall portions of the cylinder block 1 have flat outer surfaces extending parallel to the axis of the driving shaft 4, and in which are formed recesses 21 at center thereof. The refrigerant outlet ports 20 each have the other end opening into an associated one of the recesses 21.

Covers 22 having arcuately recessed inner surfaces are secured to the flat outer surfaces of the cylinder block 1 and define valve-accommodating spaces 23 together with the recesses 21. Each of the covers 22 has two stoppers 24 projected toward the cylinder block 1 and opposed to the refrigerant outlet ports 20.

Arranged within each of the valve-accommodating spaces 23 are two cylindrical discharge valves 25 which each have an axial cutout resiliently supported by the cover 22 and a portion opposite to the cutout disposed in contact with an open end of an associated one of the refrigerant inlet ports 20 to normally close same except when it is forcedly opened by the compressed refrigerant gas from the compression chamber.

The high pressure chamber 18 and each of the valve-accommodating spaces 23 communicate with each other via through holes 26 formed in the cylinder block 1 and through the front side block 7.

In this embodiment, the front and rear side blocks 7, 8, cylinder block 1, rotor 2, and vanes 6 are formed of an aluminum alloy containing Si. Preferably, the aluminum alloy contains 17 to 20% by weight Si. Inner end surfaces of the front and rear side blocks on which the rotor 2 and the vanes 6 slide, and outer surfaces of the vanes 6 are each coated with a Ni-based composite plating layer having polytetrafluoroethylene (hereinafter referred to as "PTFE") dispersed therein by means of electroless plating. The preferable plating layer comprises 88 to 95% by weight Ni and 5 to 12% by weight PTFE, though these percents are not limitative, but Ni and PTFE may be contained in other percents. More preferably, the plating layer comprises 90% by weight Ni and 10% by weight PTFE. In plating, the coating surfaces are subjected beforehand to a sequence of preliminary treatments of degreasing, treatment with mixed acid, and zinc immersion, and to plating to form a primary coat of Ni and P having a thickness of 1 to 10 microns. The plating layer has a uniform and accurate thickness. Therefore, the coated component parts can be used without being subjected to finishing. The reason for coating the above sliding surfaces with PTFE-dispersed Ni electroless composite plating layers is as follows: It is well known that wear and seizure can occur when two solid objects slide on each other, and the possibility of occurrence depends upon the material, structure, hardness, etc. of the solid objects. Therefore, in order to compare a Si-Al alloy coated with the above plating material with a Si-Al alloy not coated with the plating material, the present inventor has conducted a Falex seizure test to determine the load necessary for occurrence of seizure.

More specifically, as shown in FIG. 3, a pin 30 is formed of one material while blocks 31 having a V-shaped groove are formed of another material, and the blocks 31 are forcedly brought into pressure contact with the pin 30 while rotating the latter to measure a load (hereinafter referred to as "seizure load") on the blocks 31 under which seizure arises. The results of the test as well as the testing conditions thereof are shown in Table 1.

The seizure load P is expressed by an equation of $P=F/2\sqrt{2}$, where the V-shaped groove of the blocks has an angle of 90° and the force applied on each block 31 is represented by F. Further, the lower limit of the seizure load which is suitable for practical use is 280 Kg.

TABLE 1

| Results of Falex Test | | | |
|---|---|---|---|
| Test pieces | Pin | Block | Seizure load (Kg) |
| No. 1 | 12% Si ca. | 12% Si ca. | 50 |
| No. 2 | 12% Si ex. | 12% Si ca. | 70 |
| No. 3 | 12% Si ex. | 20% Si ca. + iron plating | 700 or more |
| No. 4 | 12% Si ca. | 20% Si ca. + (Ni-PTFE) composite plating | 700 or more |
| No. 5 | 12% Si ca. | 12% Si ca. + (Ni-PTFE) composite plating | 700 or more |
| No. 6 | 12% Si ca. + (Ni-PTFE) composite plating | 12% Si ca. + (Ni-PTFE) composite plating | 700 or more |

Note
ca.: casted piece;
ex.: piece prepared by powder extrusion
Percentage is weight %.
Testing conditions:
Testing machine: Falex seizure tester
Rotational speed of pin: 0.39 m/sec
Lubricating oil: SUNISO 5GS (commercial product manufactured by Nihon Sun Sekiyu Kabushiki Kaisha)
Oil temperature: 80° C.
Load increasing method: Load is stepwise increased.

From the above test results, it is clearly seen that as compared with the seizure loads obtained with Test pieces Nos. 1 and 2 which are formed of an aluminum alloy containing Si, those obtained with Test-pieces Nos. 5 and 6 which are formed of the same material but coated with a Ni-PTFE composite plating layer showed far greater values of 700 Kg or more. The reason for this improvement is presumably that since PTFE which has excellent lubricity and slidability is dispersed in the Ni-based plating material, the coated surfaces have high thickness stability, low frictional resistance, and high hardness to thereby improve the anti-seizure degree of the test pieces. Further, the coated surfaces according to the present invention have improved wear resistance.

The present invention is based upon the above findings. In this embodiment, the material forming Test-pieces No. 5 which is advantageous in respect of manufacturing cost is used to form component parts of the compressor.

Further, according to the present invention, various combinations of the materials forming the component parts of the compressor can be selected as shown in Table 2. Similar results can be obtained with any of the combinations of materials shown in Table 2, if at least one of the four component parts is coated with the same plating material according to the invention.

TABLE 2

| | Combination of Materials | | | |
|---|---|---|---|---|
| | Side blocks | Rotor | Vane | Cylinder block |
| 1 | Alm. (ca.) + (Ni-PTFE) composite plating | Alm. (ex.) | Alm. (ex.) + (Ni-PTFE) composite plating | Alm. (ca.) |
| 2 | Alm. (ca.) + (Ni-PTFE) composite plating | Alm. (ex.) + (Ni-PTFE) composite plating | Alm. (ex.) + (Ni-PTFE) composite plating | Alm. (ca.) |
| 3 | Alm. (ca.) + (Ni-PTFE) composite plating | Alm. (ex.) + (Ni-PTFE) composite plating | Alm. (ex.) | Alm. (ca.) + (Ni-PTFE) composite plating |

Figure 4:
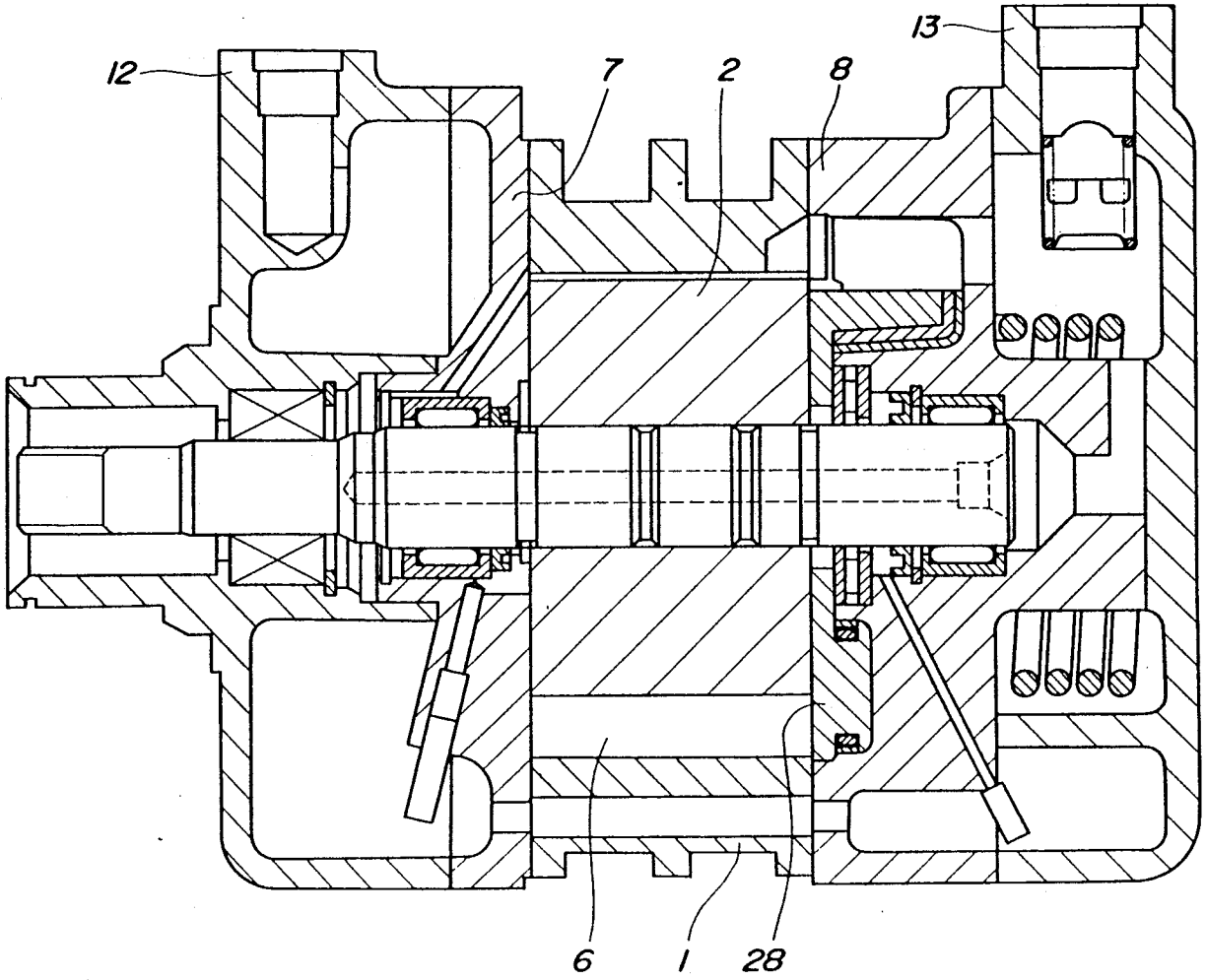
FIG. 4 is a longitudinal cross-sectional view of a vane compressor according to a second embodiment of the present invention.

Note
Alm.: Aluminum alloy;
ca.: casted piece
ex.: piece prepared by powder extrusion FIG. 4 shows a second embodiment of the vane compressor according to the invention. A plate member 28, which is formed of an aluminum alloy as specified above, is interposed between the rear side block 8 and the rotor 2 for rotation about its own axis so that the rotor 2 and the vanes 6 slide thereon. The plate member 28 is adapted to cause the capacity of the compressor to vary depending upon the angular position thereof, as disclosed, e.g. by U.S. Pat. No. 4,778,352. The plating according to the invention is provided on an end face of the plate member 28 which slides on the rotor 2, instead of the rear side block, as distinct from the first embodiment, providing the same results as those obtained by the first embodiment.

As described above, according to the invention, the cylinder block, front and rear side blocks, rotor, and vanes are formed of an aluminum alloy, whereby the weight of the compressor per se is reduced. Further, the sliding surfaces of at least one of the component parts are subjected to Ni-PTFE electroless composite plating, so that the coated surfaces have uniform films with stable thickness formed thereon, thereby having excellent dry lubricity, low frictional resistance, and high hardness by virtue of dispersion of fine particles of PTFE in the plating layer. Thus, the coated surfaces have an improved degree of anti-seizure and improved wear resistance to thereby enhance the performance of the compressor as well as prolong the effective life thereof.

Further, since the plating layer according to the invention is not so hard (Hv=800–1000) as the conventional composite plating layer in which ceramic is dispersed, it is possible to reduce the manufacturing cost of the compressor and improve the productivity.

The component parts coated with the Ni-PTFE electroless composite plating material according to the present invention are free from exfoliation of the plating layer due to repeated thermal shock, which can occur with the conventional iron plating layer, by virtue of mitigation of the stress by the Ni and PTFE, and therefore are suitable for use in the compressor which undergoes great thermal changes. The plating layer has an accurate and uniform thickness by virtue of electroless plating. Therefore, simpler preliminary treatments before the plating can be employed than those applied before the iron plating, making it possible to omit the finishing operation and hence resulting in markedly reduced manufacturing cost and improved productivity.

What is claimed is:

1. In a vane compressor including a cylinder formed by a cylinder block, and front and rear side blocks closing opposite ends of said cylinder block, a rotor rotatably received within said cylinder, said rotor having vane slits formed in an outer peripheral surface thereof, and vanes slidably fitted respectively in said vane slits, the improvement wherein said cylinder block, front and rear side blocks, rotor and vanes are formed of an aluminum-based alloy, and inner end surfaces of the front and rear side blocks on which the rotor and vanes slide, and outer surfaces of the vanes are each coated with Ni electroless composite plating layers having polytetrafluoroethylene (PTFE) dispersed therein.

2. A vane compressor as claimed in claim 1, wherein said Ni electroless composite plating layers having polytetrafluoroethylene (PTFE) dispersed therein contain 88 to 95% by weight Ni and 5 to 12% by weight polytetrafluoroethylene (PTFE).

3. A vane compressor as claimed in claim 1, wherein said Ni electroless composite plating layers having polytetrafluoroethylene (PTFE) dispersed therein have a thickness of 10 to 20 microns.

4. A vane compressor as claimed in claim 1, wherein said aluminum-based alloy contains 17 to 20% by weight Si.

5. In a vane compressor including a cylinder formed by a cylinder block, and front and rear side blocks closing opposite ends of said cylinder block, a rotor rotatably received within said cylinder, said rotor having vane slits formed in an outer peripheral surface thereof, vanes slidably fitted respectively in said vane slits, and a plate member interposed between said rear side block and said rotor for causing the capacity of said compressor to vary depending upon angular position thereof, the improvement wherein said cylinder block, front and rear side blocks, rotor, vanes, and plate member are formed of an aluminum-based alloy, and inner end surfaces of the front and rear side blocks on which the rotor and the vanes slide, and outer surfaces of the vanes are each coated with Ni electroless composite plating layers having polytetrafluoroethylene (PTFE) dispersed therein.

* * * * *